United States Patent [19]

Vandenberg et al.

[11] 4,253,562

[45] Mar. 3, 1981

[54] DISPLAY PACKAGING FOR SOFT MERCHANDISE

[76] Inventors: John D. Vandenberg, 31 Mount Joy Ave., Scarsdale, N.Y. 10583; Leonard B. Vandenberg, 710 Sanders Ave., Scotia, N.Y. 12302

[21] Appl. No.: 39,517

[22] Filed: Jul. 23, 1979

[51] Int. Cl.[3] ..... B65D 27/00; B65D 65/16; B65D 85/62

[52] U.S. Cl. ..... 206/45.33; 206/503; 229/53; 229/55

[58] Field of Search ..... 206/45.33, 503; 190/41 R; 229/55, 53; 220/69; 206/503

[56] References Cited

U.S. PATENT DOCUMENTS

| | | | |
|---|---|---|---|
| 2,847,100 | 8/1958 | Hotchner | 190/41 R |
| 2,917,223 | 12/1959 | Le Bolt et al. | 229/53 |
| 3,331,501 | 7/1967 | Stewart, Jr. | 229/55 |
| 3,385,506 | 5/1968 | Ryburn | 229/55 |
| 3,395,792 | 8/1968 | Larson | 229/55 |
| 3,396,901 | 8/1968 | McFedries | 229/55 |
| 3,490,583 | 1/1970 | Cook | 220/69 |
| 3,495,761 | 2/1970 | Turai et al. | 229/55 |
| 3,550,839 | 12/1970 | Clayton | 229/55 |
| 4,085,851 | 4/1978 | Young | 229/53 |

*Primary Examiner*—William T. Dixson, Jr.
*Attorney, Agent, or Firm*—Robert J. Bird

[57] ABSTRACT

A merchandise display package having transparent and adhesive properties for convenient display, protection, and stacking of soft merchandise.

2 Claims, 3 Drawing Figures

DISPLAY PACKAGING FOR SOFT MERCHANDISE

BACKGROUND AND SUMMARY OF THE INVENTION

This invention relates to merchandise display packaging, more particularly a transparent package or envelope for protection, display, and stacking of soft goods.

In retail stores where such goods are sold, soft goods such as shirts, blouses, pajamas, blankets, sheets and the like are generally packaged in transparent material such as cellophane for protection and display of the contents. These packages serve several purposes and must meet several requirements, as follows:

1. Transparency—so that the customer can examine the contents without removing the cover.
2. Strength—sufficient to withstand handling without tearing, breaking, or deteriorating in the display environment.
3. Protection—of the contents so they do not become soiled while being displayed and handled.
4. Information—the covering usually supplies, or is transparent to, information as to size, cost, description or other data relating to the contents.
5. Low cost—in order to remain competitive, the cost of such packaging must be minimal.
6. Low Display Cost—this relates to the cost of labor and facilities used to keep the goods on display.

The last requirement, low display cost, is a generally unrecognized or unchallenged major cost in retail merchandising. Merchandise such as shirts, pajamas, blankets and the like must be displayed in a large variety of sizes, colors, prices, and styles in order to attract customer interest. To accommodate as much as possible of a great variety, such goods are normally stacked to minimize space required for display. The maintenance of orderly stacks of sizes, color, and styles in various price categories is a major sales cost at the present time. This is due in large measure to slipping and sliding of stacked packages, one over another, because their wrappings are generally of a hard slippery plastic like cellophane. The stacked items slip into disarray and this necessitates laborious and costly resorting and restacking of the goods in order to make them presentable and attractive. This cost has been largely unrecognized to the present, or at least unchallanged, but it is a substantial percentage of retail merchandising cost.

An object of the present invention is to provide a transparent protective display package for soft goods, which package is adapted for adhesive or frictional engagement with other like packages for stability of stacking.

The details, function, and benefits of various modifications of this invention will now be described more specifically with reference to the accompanying drawing.

It is to be understood that the cover material itself may also be thermally or otherwise treated to form projections for the interlocking purpose.

DRAWING

Description

Figure 1:
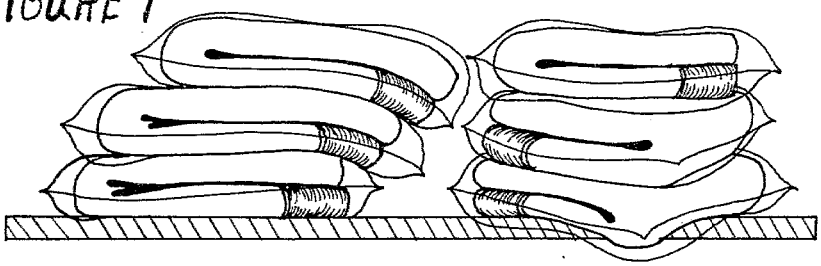
FIG. 1 represents a stack of soft goods in display envelopes.

The invention may be described as a transparent protective display package for soft goods, for example shirts. Consider a typical cellophane wrapper or envelope in which shirts are generally individually displayed. This material is transparent, strong, and impervious to dirt and moisture so it is effective as a protective display envelope. However, as is well known, such envelope are also slippery and do not easily stack on a display table, nor do they remain well stacked. FIG. 1 represents a stack of such envelopes, containing blankets and piled atop a table or counter.

Figure 2:
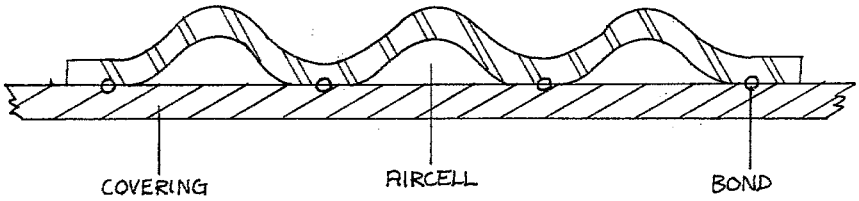
FIG. 2 is an enlarged sectional view of a portion of one display envelope according to one form of this invention.

In one form of the invention as represented in FIG. 2, an outer strip or patch of the envelope material is affixed to the envelope in such a way as to form an array of air cells or bubble protuberances on the surface, or part of the surface, of the transparent envelope. The bubbles are spaced apart by a distance between them at least as great as their individual diameters. Preferably, this outer patch is placed over limited areas of the top and bottom faces of the envelope, though it could cover the entire envelope. When two or more such envelopes are stacked, the air bubbles of one envelope surface protrude between corresponding bubbles on the facing surface of the next envelope to provide interlocking against lateral sliding of one envelope relative to the other.

Figure 3:
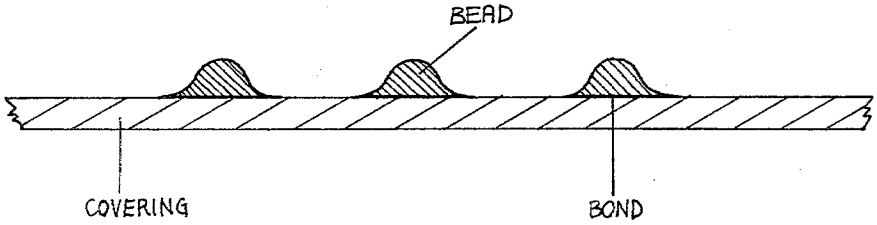
FIG. 3 is an enlarged sectional view of a portion of one display envelope according to another form of this invention.

In another form of this invention as represented in FIG. 3, the plastic envelope is provided with an array of solid projections or beads of plastic material over defined bottom and top areas of the envelope, or over the entire envelope. Again, this array of beads is arranged so that distances between beads are greater than their diameters. As in the case of the air cells, the mating of one surface on another provides interlocking against lateral sliding.

In still another form, the plastic display envelope is coated, partially on top and bottom, or entirely, with a transparent or semitransparent film of material having a relatively high coefficient of friction. Silicone, epoxy resin, and acrylic resin are examples of materials which can be applied as films on plastic envelopes with good results.

In the first and second modifications described, the air bubbles or the beads applied to the envelope can be so arranged as to provide information or code as desires or to provide decorative design to the package.

In the third modification described, the film material can be colored to provide visible information or code or decorative effect on the package.

In use, display envelopes as described can be more readily stacked and will remain so with much more stability than prior art display envelopes because lateral sliding of one envelope on another is now eliminated.

What is claimed is:

1. A display package for merchandise including a transparent envelope of single-thickness material for containment protection, and display of merchandise.

said envelope including a plurality of friction protuberances on the exterior surface thereof to provide corresponding local areas of pressure and friction whereby lateral slippage of one such package, when stacked on another, is impeded.

2. A display package for merchandise including a transparent flexible envelope for containment, protection, and display of soft merchandise, said envelope including a plurality of spaced protuberances of friction material on the exterior surface thereof to impress against the surface of another such package to thereby create local areas of pressure and friction whereby lateral slippage of said package on said other package is impeded.

* * * * *